US005138377A

United States Patent [19]

Smith et al.

[11] Patent Number: 5,138,377

[45] Date of Patent: Aug. 11, 1992

[54] INTERNAL EXPERT SYSTEM TO AID IN SERVICING

[75] Inventors: Craig A. Smith, Pittsford; Mark A. Byers; Thomas A. Wall, both of Fairport, all of N.Y.

[73] Assignee: Xerox Corporation, Stamford, Conn.

[21] Appl. No.: 704,481

[22] Filed: May 23, 1991

[51] Int. Cl.[5] ..... G03G 15/00

[52] U.S. Cl. ..... 355/207; 355/206; 355/209

[58] Field of Search ..... 355/203–209, 355/77; 364/200, 264, 264.5, 264.7, 265, 266, 267, 267.5, 274, 274.2, 276, 277, 900, 920.7

[56] References Cited

U.S. PATENT DOCUMENTS

| | | | |
|---|---|---|---|
| Re. 32,253 | 9/1986 | Bartulis et al. . | |
| 4,186,299 | 11/1980 | Batchelor | 235/304.1 |
| 4,421,404 | 12/1983 | Conly | 355/14 CU |
| 4,464,044 | 8/1984 | Matsuyama | 355/14 B |
| 4,478,509 | 10/1984 | Daughton et al. | 355/14 C |
| 4,511,242 | 4/1985 | Ashbee et al. | 355/14 C |
| 4,536,079 | 8/1985 | Lippolis et al. | 355/14 R |
| 4,583,834 | 4/1986 | Seko et al. . | |
| 4,609,919 | 9/1986 | Miyazaki et al. . | |
| 4,639,918 | 1/1987 | Linkowski | 371/20 |
| 4,721,978 | 11/1988 | Herley | 355/4 |
| 4,792,827 | 12/1988 | Ogura . | |
| 4,922,295 | 5/1990 | Takano et al. | 355/206 X |

*Primary Examiner*—R. L. Moses

*Attorney, Agent, or Firm*—Ronald F. Chapuran

[57] ABSTRACT

A control technique for monitoring machine status conditions and initiating interactive dialogue with an operator, the control having an expert system, the expert system monitoring predetermined status conditions of the machine for automatic correction or for communication to the operator, including the steps of monitoring with the expert system said predetermined status conditions relative to the operation of the machine, recognizing the deviation of the machine operation from said predetermined status conditions, responding to the deviation of the machine operation from said predetermined status conditions, and optionally atomatically correcting the machine to return the machine to standard operation, or initiating an interactive dialogue with the operator to return the machine to standard operation.

5 Claims, 3 Drawing Sheets

INTERNAL EXPERT SYSTEM TO AID IN SERVICING

BACKGROUND OF THE INVENTION

The invention relates to reproduction machines, and more particularly, to a machine with an internal expert system capable of responding to deviations from standard parameters to make corrections and adjustment or able to dialogue with an operator to restore the machine to standard operation.

Modern day reproduction machines such as printers and copiers utilize a software based operating system to perform essential machine functions and implement the various printing and copying jobs of which the machine is capable. However, software, particularly that used in high speed multi-function machines, is subject to various problems and faults. Additional problems also arise with the machine hardware which in machines of this type is extremely complex and sophisticated. Hardware and software problems that occur typically happen at a low non-periodic rate and thus are very difficult to replicate when servicing the machine and therefore difficult to satisfactorily resolve. It is important for the servicing organization to be able to access key machine operating information, and particularly information reflecting on the performance of the machine control system.

Internal diagnostic tools such as diagnostic algorithms that response to various sensors and detectors within the machine are very helpful in analyzing and maintaining the operation of the machine. However, the diagnostics can be variable depending upon such factors as machine environment, history of operation, or any additional knowledge that has been gained regarding a machine. Also, a machine control often does not have the requisite sophistication to be able to analyze all complex problems. In this respect, it can be understood that it would be desirable to provide diagnostic algorithms that are capable of being adjusted to provide different diagnostic criteria for changing machine conditions or environments. It would also be desirable for a machine to be able to analyze its internal operation and communicate with an operator to obtain additional information to assist in the diagnosis.

PRIOR ART

It is known in the prior art to provide an expert system at a remote location to diagnose problems. Also, as related to xerographic machines, U.S. Pat. No. 4,186,299 to Batchelor, assigned to Xerox Corporation, and the U.S. Pat. No. 4,464,044 to Matsuyama disclose copying machines having keypads primarily for directing normal copying operations. The keypads and associated logic also serve the additional function of initiating diagnostic routines U.S. Pat. No. 4,536,079 to Lippolis et al. discloses a copying machine keyboard that is usable by a service agent to change a timing parameter for diagnostic and repair purposes.

U.S. Pat. No. 4,478,509 to Daughton et al., assigned to Xerox Corporation, discloses a control console which can be used to direct copy or other runs. See column 18, line 60.

U.S. Pat. No. 4,639,918 to Linkowski discloses a calculator keyboard that is used to control diagnostic functions of a mailing machine. During regular operation, the same key pad is used to control the normal functioning of the machine.

Also, U.S. Pat. No. 4,421,404 is directed to a document handler job recovery technique and discloses in col. 2, last line, and col. 3, lines 1–7, that microprocessor routines are included in the copier that have "aided in the establishment of a degree of "artificial intelligence" to anticipate the needs of the machine user in document feeder operations, collate, and other areas."

U.S. Pat. No. 4,511,242 discloses an electronic paper alignment apparatus and technique in a copier. In col. 2, lines 65–68, and col. 3, liens 1–17, the patent mentions various uses of microprocessors to establish "artificial intelligence".

U.S. Pat. No. 4,721,978 is directed to a color toner concentration control system discloses in col. 8, lines 37–42, that it is old to use "artificial intelligence" to anticipate a need and answer that need in a copier.

A difficulty with the prior art controls is that communication with an expert system is generally remote and not available internally with the machine for interactive dialogue with an operator. In addition, the prior art remote expert systems are limited in capability to automatically adjust machine parameters because of the limitation of receiving on-line interactive input. Also, diagnostic systems such a referenced above are not "expert" based and are limited in diagnostic capability.

It is an object of the present invention, therefore, to provide a new and improved technique that provides an expert system as part of a machine control and provides on line interactive dialogue with the machine operator or service representative. It is a further object of the present invention to provide a more fully automatic system for machine operating parameter adjustment. Further advantages of the present invention will become apparent as the following description proceeds and features characterizing the invention will be pointed out with particularity in the claims annexed to and forming a part of this specification.

SUMMARY OF THE INVENTION

A machine control having an expert system, the control cooperating with the operating components to produce images on copy sheets, the expert system monitoring predetermined status conditions of the machine for automatic correction or for communication to the operator, including the steps of monitoring with the expert system said predetermined status conditions relative to the operation of the machine, recognizing the deviation of the machine operation from said predetermined status conditions, responding to the deviation of the machine operation from said predetermined status conditions, and optionally automatically correcting the machine to return the machine to standard operation, or initiating an interactive dialogue with the operator to return the machine to standard operation.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
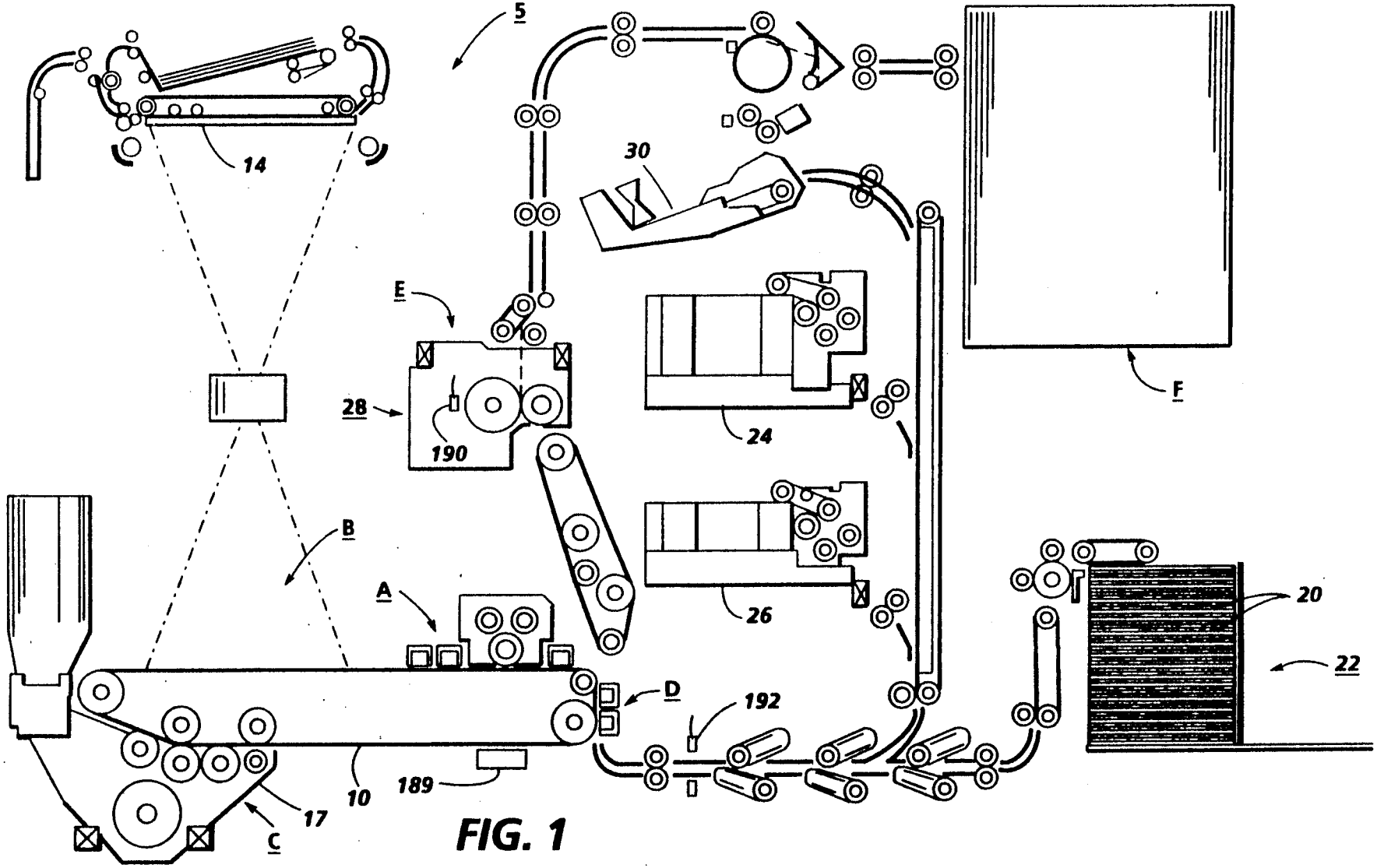
FIG. 1 is a schematic elevational view depicting various operating components and sub-systems of a typical machine incorporating the present invention.
Figure 2:
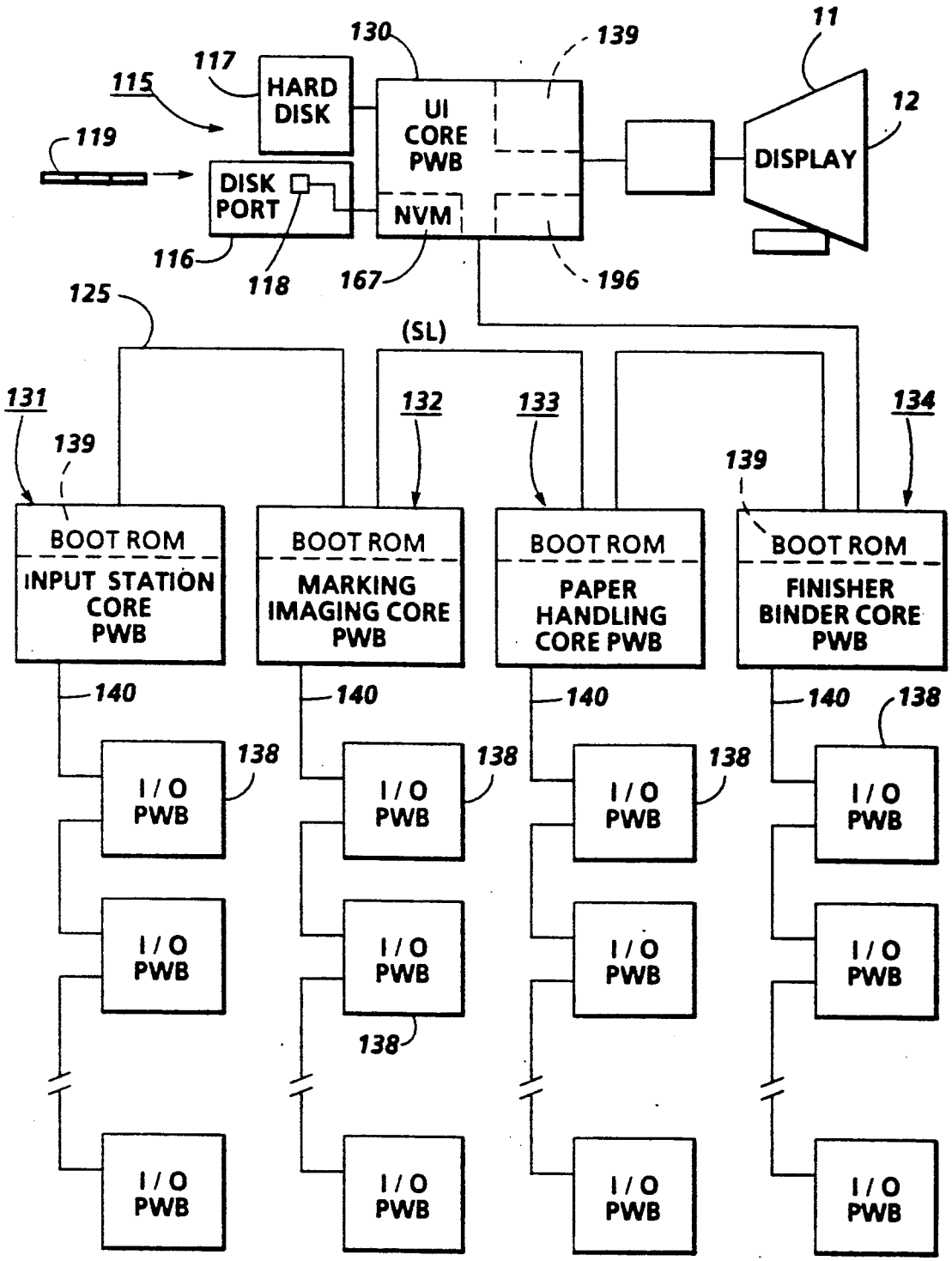
FIG. 2 is a block diagram depicting the machine Operating System Printed Wiring Boards and shared line connections for the machine described in FIG. 1.

For a general understanding of the features of the present invention, reference is made to the drawings. In the drawings, like reference numerals have been used throughout to identify identical elements. Referring to FIGS. 1 and 2, there is shown an electrophotographic reproduction machine 5 composed of a plurality of programmable components and sub-systems which cooperate to carry out the copying or printing job programmed through a touch dialogue screen 12 of a User Interface (UI) 11.

Machine 5 has a photoreceptor in the form of a movable photoconductive belt 10 which is charged at charging station A to a relatively high, substantially uniform potential. Next, the charged photoconductive belt is advanced through imaging station B where light rays reflected from the document being copied on platen 14 create an electrostatic latent image on photoconductive belt 10.

The electrostatic latent image is developed at development station C by a magnetic brush developer unit 17 and the developed image transferred at transfer station D to a copy sheet supplied from tray 22, 24, or 26. Following transfer, the copy sheet bearing the transferred image is fed to fusing station E where a fuser 28 permanently affixes the toner powder image to the copy sheet. After fusing, the copy sheets are fed to either finishing station F or to duplex tray 30 from where the sheets are fed back to transfer station D for transfer of the second toner powder image to the opposed sides of the copy sheets.

Referring to FIG. 2, operation of the various components of machine 5 is regulated by a control system which uses operating software stored in memory 115 to operate the various machine components in an integrated fashion to produce copies and prints. The control system includes a plurality of printed wiring boards (PWBs), there being a UI core PWB 130, an Input Station core PWB 131, a Marking Imaging core PWV 132, a Paper Handling core PWB 133, and a Finisher Binder core PWV 134 together with various Input/Output (I/O) PWBs 138. A Shared Line (SL) 125 couples the core PWBs 130, 131, 132, 133, 134 with each other and with memory 115 while local buses 140 serve to couple the I/O PWBs 138 with each other and with their associated core PWB. Programming and operating control over machine 5 is accomplished through touch dialogue screen 12 of UI 11. The operating software includes application software for implementing and coordinating operation of the machine components.

Memory 115 includes a main memory in the form of a hard or rigid disk 117 on which the machine operating software is stored. On machine power up, the operating software is loaded from memory 115 to UI core PWV 130 and from there to the remaining core PWBs 131, 132, 133, 134 via SL 125. Disk 117 preferably comprises two platter, four head disks with a formatted storage capacity of approximately 20 megabytes. Additional ROM, RAM, and NVM memory types are resident at various locations within machine 5, with each core PWV 130, 131, 132, 134 having a boot ROM's for controlling downloading of operating software to the PWV's for fault detection, etc. A NVM 167 and expert system 196 are provided in UI core PWV 130. Boot ROMs also enable transmission of operating software and control data to and from PWBs 130, 131, 132, 134 via SL 125 and control data to and from I/O PWBs 138 via local buses 140.

A floppy disk port 116 provides program loading access to memory 115 for the purpose of entering changes to the operating software, loading specific programs such as diagnostic programs, retrieving stored data such as machine faults, etc. using floppy disks 119. Port 116 includes a suitable read/write head 118 for reading and/or writing from and to a disk 119 in port 116. Floppy disks 119 preferably comprise 3.5 inch, dual sided micro disks with a formatted storage capacity of approximately 720 kilobytes.

Figure 3:
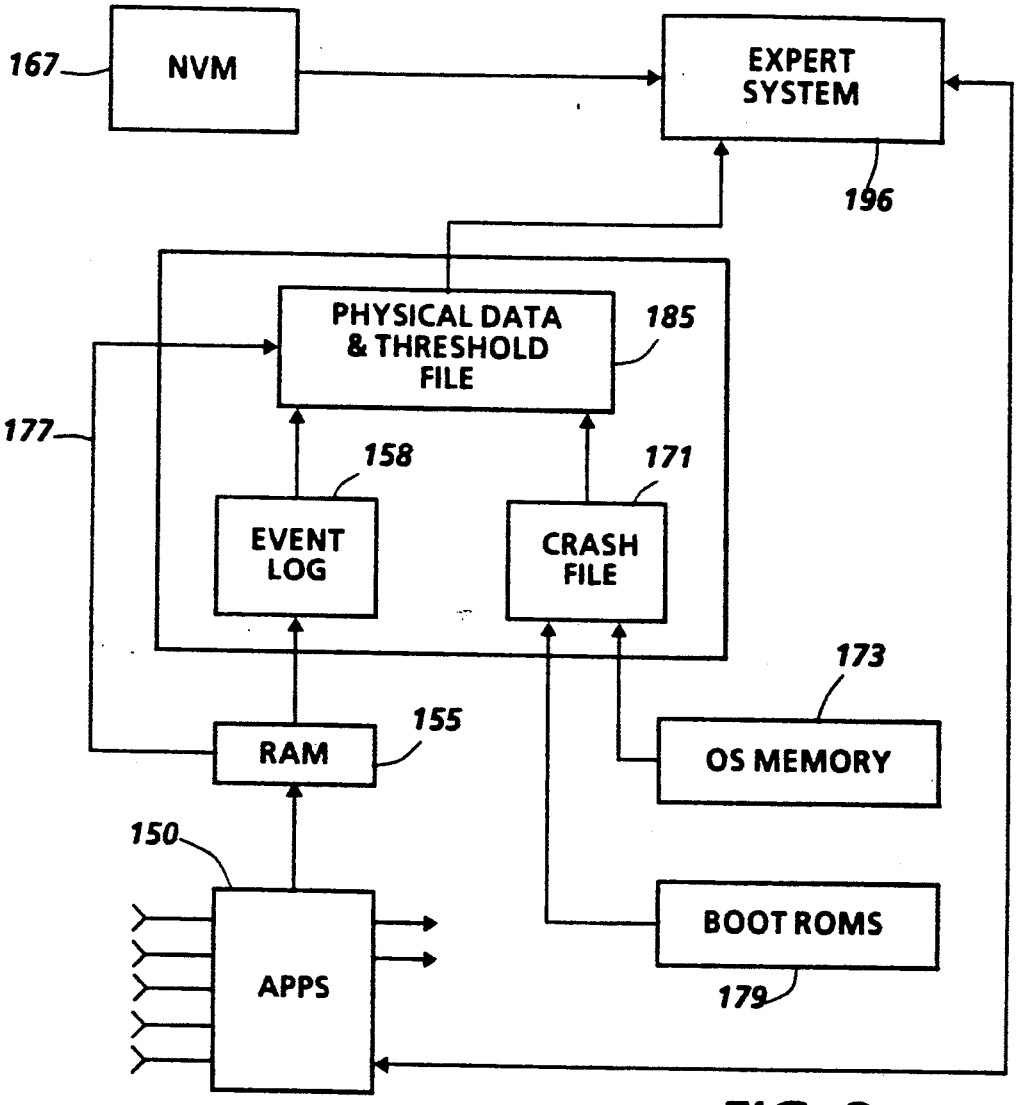
FIG. 3 is a block diagram depicting the data collection in accordance with the present invention.

Referring to FIG. 3, certain key machine operating events (referred to as current event data) which define the proper execution of the control system such as user interface buttons being set, changes in application software operating states, interlock switches opening and closing, notification of control or system faults, execution of key routines, etc., are input as they occur by the applications system software 150 to dynamic memory 155. Memory 155, which may be Random Access Memory or RAM type memory, preferably provides a (not shown) circular buffer of predetermined size for storing current event data.

A data transfer means in the form of an event spooling routine in software, which is periodically called, writes the current event data accumulated in the buffer of memory 155 into an event or occurrence logger file 158 for transmission to the physical data and threshold file 185. Typically, the event spooling routine is repeated on a given cycle, i.e., after a present number of machine pitches. When called, the event spooling routine overwrites a portion of the previous event data stored in the event logger file 158 with the current event data, effectively erasing the previously oldest portion of the event data and replacing it with the newer current event data.

As will be understood, software crashes may occur from time to time during the life of the machine. In the case of most crashes, recovery is made either automatically or through the intervention of the operator, and machine 10 continues to operate normally. However, it is desirable to provide a record of the machine state at the time of the crash for use in diagnosing or servicing the machine by Expert System 196.

On each software crash, a snapshot is in effect taken of certain predetermined events (termed crash data) in the machine at the time the crash occurs. These events may, for example, consist of an image of each of the operating software (os) memory maps in PWBs 131–134, boot ROMs and an image of NVM 167. Preferably, a snapshot of the current event data in the buffer of RAM 155 is included. The block of crash data obtained is fitted into one of a number of memory areas reserved for crash files in a crash logger file 171. Crash logger file 171 is a circular queue of crash files with the crash data from each succeeding crash written to the crash files in sequence.

Certain machine operating parameters such as photoreceptor belt charge levels, fuser temperatures, etc. are permanently stored in NVM 167. These parameters represent the optimum or ideal operational settings for the machine which will result in the best possible machine performance. Typically, these operating parameters provide an operating range or window. Suitable sensors (seen also in FIG. 2) such as an Electrostatic Voltmeter (ESV) 189 for sensing photoreceptor charge levels, temperature sensor 190 for sensing the operating temperatures of fuser 28, sheet jam detectors 192 for detecting sheet jams and determining sheet timing, etc. monitor actual machine operating conditions. At discrete times during the operating cycles of machine 10, the sensors such as ESV 189, temperature sensor 190, jam detectors 192, etc. are read and the data obtained input via line 177 to the machine physical data file 185. For more detail, reference is made to U.S. Pat. No. 5,057,866 incorporated herein.

In accordance with the present invention, machine 10 employs an expert system 196 for analysis of machine operation data. The machine physical data to be analyzed by the expert system includes the event data in event logger file 158 and/or the crash data from crash logger file 171, obtained from time to time during operation of the machine and stored in a physical data file 185. Expert System 195 has conventional software for converting the byte type event data to appropriate messages for display on the screen of the User Interface. A suitable comparator may be provided in software which compares the data with the data representing the ideal machine operating parameters from NVM 167. Where the comparison indicates that current machine operating conditions are within acceptable limits, analysis of some or all of the physical data by the Expert System 196 may be avoided. In that circumstance, a message indicating that the machine is operating properly may instead be displayed. Where the comparison indicates that one or more of the current operating parameters is out of range, the part of the physical data relating to the problem is analyzed by the Expert System.

With reference to FIG. 3 the physical data and threshold file 185 stores critical machine operating threshold levels for the machine operating components such as the photoreceptor belt charge levels, fuser temperatures, and bias control levels. As discussed above various sensors and detectors monitor machine operating conditions and at discrete time during the operating cycle of the machine, these conditions are read and the data stored in the event logger file 158 and/or the crash logger file 171 to be stored in the physical data file 185 for evaluation by the Expert System. Expert System 196 provides various diagnostic and corrective functions as discussed above and other functions such as to insert selected sensor and detector information into a given or predetermined mathematical model to determine if given machine operating thresholds are exceeded.

For example, the electrostatic volt meter 189 senses photoreceptor charge levels. The threshold file 185 includes a range of voltages applicable to the photoreceptor charge for normal operation of the machine. The Expert System 196 determines if the most recently sensed photoreceptor charge level is within the acceptable charge level or exceeds the charge level or is below the charge level. It should be noted that the threshold levels are values stored in the threshold file 185 need not be a function of merely one sensor or detector reading, but a threshold level may be a function of, or based upon a combination of many machine variables that are determined by a plurality of sensors and detectors.

It is known that expert systems emulate the problem-solving processes of human experts. Expert Systems such as 196 incorporate in the form of problem solving algorithms and procedures the knowledge of human experts. Such systems differ from conventional computer controls which manipulate numbers and quantities in precisely specific ways. The expert system will state in that it has only a certain level of confidence that its answer is correct. It will rank conclusions by their likelihood of being correct.

Throughout the knowledge acquisition process, the knowledge engineer separates emerging If-Then rules into two basic categories, the "knowledge base" and the "inference engine". Distinguishing and separating these two kinds of rules is a crucial feature of expert systems. Knowledge rules state all the facts and relationships about the problem, and inference rules tell what to do with these facts to solve the problem.

Figure 4:
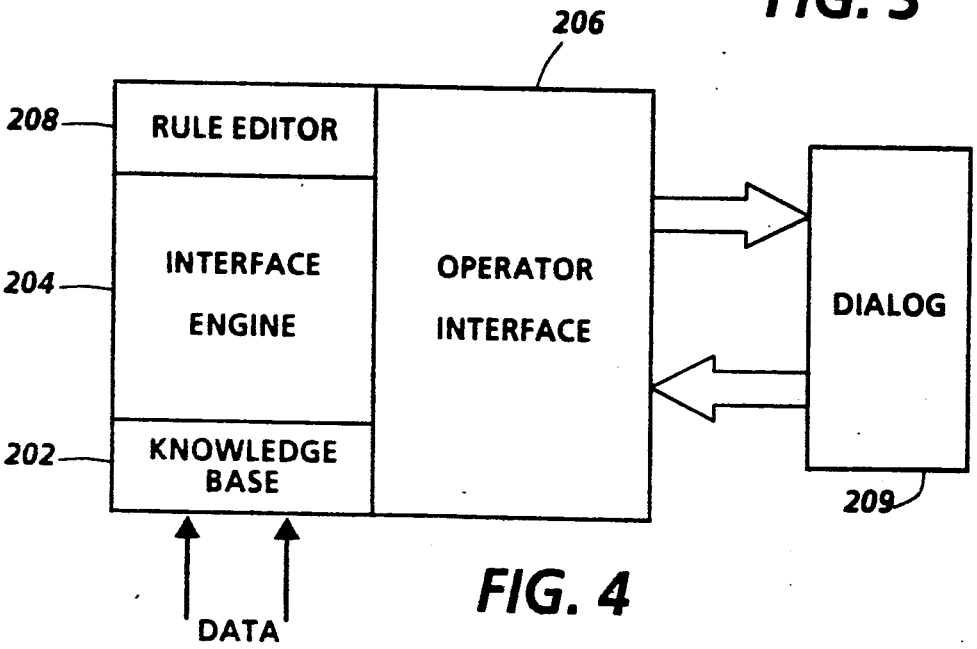
FIG. 4 is a block diagram depicting the expert system providing a portion of the control of the machine of FIG. 1 accordance with the present invention.

The Expert System 196 is generally shown in FIG. 4 including a Knowledge Base 202 having a set of rules embodying an expert's knowledge about the operation, diagnosis, and correction of the machine, an Inference Engine 204 to efficiently apply the rules of the Knowledge Base 202 to solve machine problems, an Operator Interface 206 to communicate between the operator and the Expert System, and Rule Editor 208 to assist in modifying the Knowledge Base 202. In operation, the Inference Engine 204 applies the Knowledge Base 202 rules to solve machine problems, compares the rules to data entered by the user about the problem, tracks the status of the hypothesis being tested and hypotheses that have been confirmed or rejected, asks questions to obtain needed data, states conclusions to the user, and even explains the chain of reasoning used to reach a conclusion. The function of the Operator Interface is to provide dialogue 210, that is, ask questions, request data, and state conclusions in a natural language and translate the operator input into computer language.

An essential element of the Expert System 196 is the dialogue 210 feature to enable the Expert System to proceed with analysis upon receipt of additional data from an operator or tech rep. The Expert System 196 itself includes memory with a profile of expected machine performance and parameters portion, a current switch and sensor information portion, and a table of historical machine performance and utilization events. The system monitors status conditions and initiates external communication relative to the status conditions of the machine. This procedure includes the steps of monitoring the predetermined status conditions relative to the operation of the machine, recognizing the deviation of the machine operation from said predetermined status conditions, recognizing the inability of the machine to automatically respond to the deviation to self correct, and, determining the need for external response to provide additional information for evaluation for further analysis.

Upon this determination the system will request additional information for evaluation for further analysis, and upon receipt of said additional information, determine the correct response to return the machine operation to a mode not in deviation from said predetermined status conditions. It also automatically provides the correct response to return the machine operation to a mode not in deviation from the predetermined status conditions. The Expert System 196, as discussed, periodically responds to the operating conditions or parameters being analyzed to determine if there is a threshold level or value stored in threshold file 185 that is outside the range of acceptable machine operation. If all threshold levels are determined to be within acceptable machine operation, no action is taken by the Expert System 196. However, in accordance with the present invention, if it is determined that the sensed values from the sensors and detectors represent a condition that is outside the range or accepted levels of threshold values as stored in threshold file 194, the Expert System 196 will respond and analyze the data and take corrective action.

In accordance with the present invention, it may be necessary for a particular machine environment for the Expert System 196 to change the threshold values or levels that are stored in threshold file 185, or to change the mathematical model or formula used to determine if the sensed and detected values exceed a threshold value. For example, it may be necessary to place a different emphasis or weight on the variables in the mathematical formula that are used to determine if the threshold level is exceeded, or it may be even desirable to add or delete some of the variables in the mathematical formula that are used by the Expert System 196 to determine if the threshold level has been exceeded. Upon the changing of the model equations or parameters used to determine that sensed conditions are within a threshold range, the Expert System 196 will then determine a threshold exceeding level based upon the new mathematical formula for all subsequent sensed and detected values. The use of the new mathematical formulas for determining threshold levels and even the changed threshold ranges or values themselves will continue until the mathematical formulas and threshold levels are again changed.

While the invention has been described with reference to the structure disclosed, it is not confined to the details set forth, but is intended to cover such modifications or changes as may come within the scope of the following claims.

We claim:

1. In a printing system having a machine with a plurality of operating components, a control and an expert system, the control cooperating with the operating components to produce images on copy sheets, the expert system monitoring predetermined status conditions of the machine for automatic correction or for communication to the operator, the method of the machine monitoring the status conditions and initiating communication relative to the status conditions of the machine comprising the steps of:

monitoring with the expert system said predetermined status conditions relative to the operation of the machine, recognizing the deviation of the machine operation from said predetermined status conditions, responding to the deviation of the machine operation from said predetermined status conditions, and optionally automatically correcting the machine to return the machine to standard operation, or initiating an interactive dialogue with the operator to return the machine to standard operation including the step of requesting operator input of relevant data.

2. The method of claim 1 wherein the control provides status points related to the operating components and the step of monitoring with the expert system said predetermined status conditions relative to the operation of the machine includes the step of determining a variation of the status points from a threshold level.

3. The method of claim 2 wherein the step of determining the variation of the status points from a threshold level includes the step of calculating a value in accordance with a given equation related to the status points.

4. The method of claim 3 including the step of adjusting selected operating components of said machine from said expert system.

5. In a printing system having a machine with a plurality of operating components for producing image impressions on image bearing members, a control cooperating with the operating components to produce the images on the image bearing members, and an expert system, the expert system including memory with the profile of expected machine performance and parameters portion, a current switch and sensor information portion, and a table of historical machine performance and utilization events, the method of the machine monitoring status conditions and initiating external communication relative to the status conditions of the machine comprising the steps of:

monitoring said predetermined status conditions relative to the operation of the machine, recognizing the deviation of the machine operation from said predetermined status conditions, recognizing the inability of the machine to automatically respond to the deviation to self correct, determining the need for external response to provide additional information for evaluation for further analysis, requesting said additional information for evaluation for further analysis, and upon receipt of said additional information, determining the correct response to return the machine operation to a mode not in deviation from said predetermined status conditions, and automatically providing the correct response to return the machine operation to a mode not in deviation from said predetermined status conditions.

* * * * *